US008456371B2

(12) United States Patent
Chen et al.

(10) Patent No.: US 8,456,371 B2
(45) Date of Patent: Jun. 4, 2013

(54) SHIELDING ANTENNAS IN WIRELESS APPLICATION DEVICES

(75) Inventors: Jia-woei Chen, Taipei (TW); Po-chih Chen, Taipei (TW)

(73) Assignee: Laird Technologies Taiwan Inc., Taipei County (TW)

( * ) Notice: Subject to any disclaimer, the term of this patent is extended or adjusted under 35 U.S.C. 154(b) by 0 days.

(21) Appl. No.: 13/420,714

(22) Filed: Mar. 15, 2012

(65) Prior Publication Data

US 2012/0176280 A1 Jul. 12, 2012

Related U.S. Application Data

(63) Continuation of application No. PCT/IB2009/006971, filed on Sep. 16, 2009.

(51) Int. Cl.
*H01Q 1/24* (2006.01)

(52) U.S. Cl.
USPC ..... 343/702

(58) Field of Classification Search
USPC ..... 343/702, 841, 882, 872, 873; 455/575.7
See application file for complete search history.

(56) References Cited

U.S. PATENT DOCUMENTS 5,677,698 A * 10/1997 Snowdon ..... 343/770
6,853,336 B2 2/2005 Asano et al.
6,930,644 B2 * 8/2005 Konishi et al. ..... 343/702
7,009,568 B2 * 3/2006 Amemiya et al. ..... 343/702
7,167,726 B2 * 1/2007 Ghosh et al. ..... 455/557
7,271,769 B2 * 9/2007 Asano et al. ..... 343/702
2007/0085753 A1 4/2007 Wu et al.
2008/0278384 A1 11/2008 Shimasaki et al.

FOREIGN PATENT DOCUMENTS

WO WO 2011/033332 3/2011

OTHER PUBLICATIONS

International Search Report and Written Opinion dated Oct. 29, 2012 from PCT Application No. PCT/IB2009/006971 filed Sep. 16, 2009 (published as WO2011/033332). The instant application is a continuation of PCT/IB2009/006971.

Wong et al., Diversity Metal-Plate Planar Inverted-F Antenna for WLAN Operation, Electronic Letters, IEEE Xplore, Apr. 3, 2003, vol. 39, No. 7; pp. 590-591.

Wong et al., Dual-Band Flat-Plate Antenna with a Shorted Parasitic Element for Laptop Applications, IEEE Transactions on Antennas and Propagation, vol. 53, No. 1, Jan. 2005; pp. 539-544.

* cited by examiner

*Primary Examiner* — Huedung Mancuso
(74) *Attorney, Agent, or Firm* — Harness, Dickey & Pierce, P.L.C.

(57) ABSTRACT

An antenna assembly that includes an antenna module fitting between a display panel of an electronic device and a metallic cover of the device. The antenna module includes an antenna and a support for the antenna. A shielding layer fits between the antenna module and the cover. The shielding layer has a grounding area configured for electrical connection with the antenna and for electrical isolation from the cover.

20 Claims, 12 Drawing Sheets

| WIFI | |
|---|---|
| 2400.0 | -3.8 dB |
| 2415.0 | -5.0 dB |
| 2430.0 | -7.1 dB |
| 2445.0 | -10.6 dB |
| 2460.0 | -13.4 dB |
| 2483.5 | -8.4 dB |

SHIELDING ANTENNAS IN WIRELESS APPLICATION DEVICES

CROSS-REFERENCE TO RELATED APPLICATION

This application is a continuation of International Patent Application No. PCT/IB2009/006971 filed Sep. 16, 2009 (and published as WO 2011/033332 on Mar. 24, 2011). The entire disclosure of the above application is incorporated herein by reference.

FIELD

The present disclosure relates to shielding antennas in wireless application devices.

BACKGROUND

This section provides background information related to the present disclosure which is not necessarily prior art.

Wireless application devices, such as laptop computers, cellular phones, etc. are constantly being redesigned to reduce their sizes and costs while improving their performance. Laptop computers, for example, have generally become sturdier and more visually pleasing as a result of design improvements. In anticipation of consumer demand for thinner, ultra-low-voltage devices, many laptop providers have begun to replace plastic covers with metallic ones. Many laptop covers are currently being fabricated, e.g., from magnesium/aluminum alloy materials. To allow laptop antennas to radiate freely in a tight environment, laptops have traditionally been provided with "antenna windows" for antenna ground clearance. Because a metallic cover can absorb energy and detune the impedance during laptop use, optimal placement of antennas in such a laptop becomes more complicated.

FIG. 1 illustrates a conventional laptop antenna configuration 20. A cover 24 includes a bezel (not shown) for a display panel 28. An antenna 32 is mounted next to the display panel 28. Plastic laptop covers commonly include the antenna configuration 20. Typical return loss and efficiency for the configuration 20 when used in a plastic cover were computer-simulated by the inventors and are shown respectively in FIG. 2 and FIG. 3. As shown in FIG. 3, peak total antenna efficiency is approximately −2 decibels (dB). If the antenna configuration 20 is used in a metallic cover, there may be considerable degradation in return loss and efficiency. For example, computer-simulated return loss and efficiency for the configuration 20 when used in a 96% alumina cover are shown respectively in FIG. 4 and FIG. 5.

SUMMARY

This section provides a general summary of the disclosure, and is not a comprehensive disclosure of its full scope or all of its features.

According to various aspects, example embodiments are provided of an antenna assembly that includes an antenna module fitting between a display panel of an electronic device and a cover of the device. The antenna module includes an antenna and a support for the antenna. A shielding layer fits between the antenna module and the cover. The shielding layer has a grounding area configured for electrical connection with the antenna and for electrical isolation from the cover.

In another example embodiment, a cover assembly for an electronic device includes a cover and an antenna module configured for coverage by a display panel for the device when the display panel is integrated with the cover. The antenna module includes an antenna and a support for the antenna. A shielding layer between the antenna module and the cover has a grounding area configured for electrical communication with the antenna and for electrical isolation from the cover.

In yet another example embodiment, an electronic device has a display panel mounted in a cover. The electronic device has an antenna module including an antenna supported by a substrate mounted beneath the cover and behind the display panel. A shielding layer between the antenna module and the cover has a grounding area electrically isolated from the cover and electrically connected with the antenna.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 11:
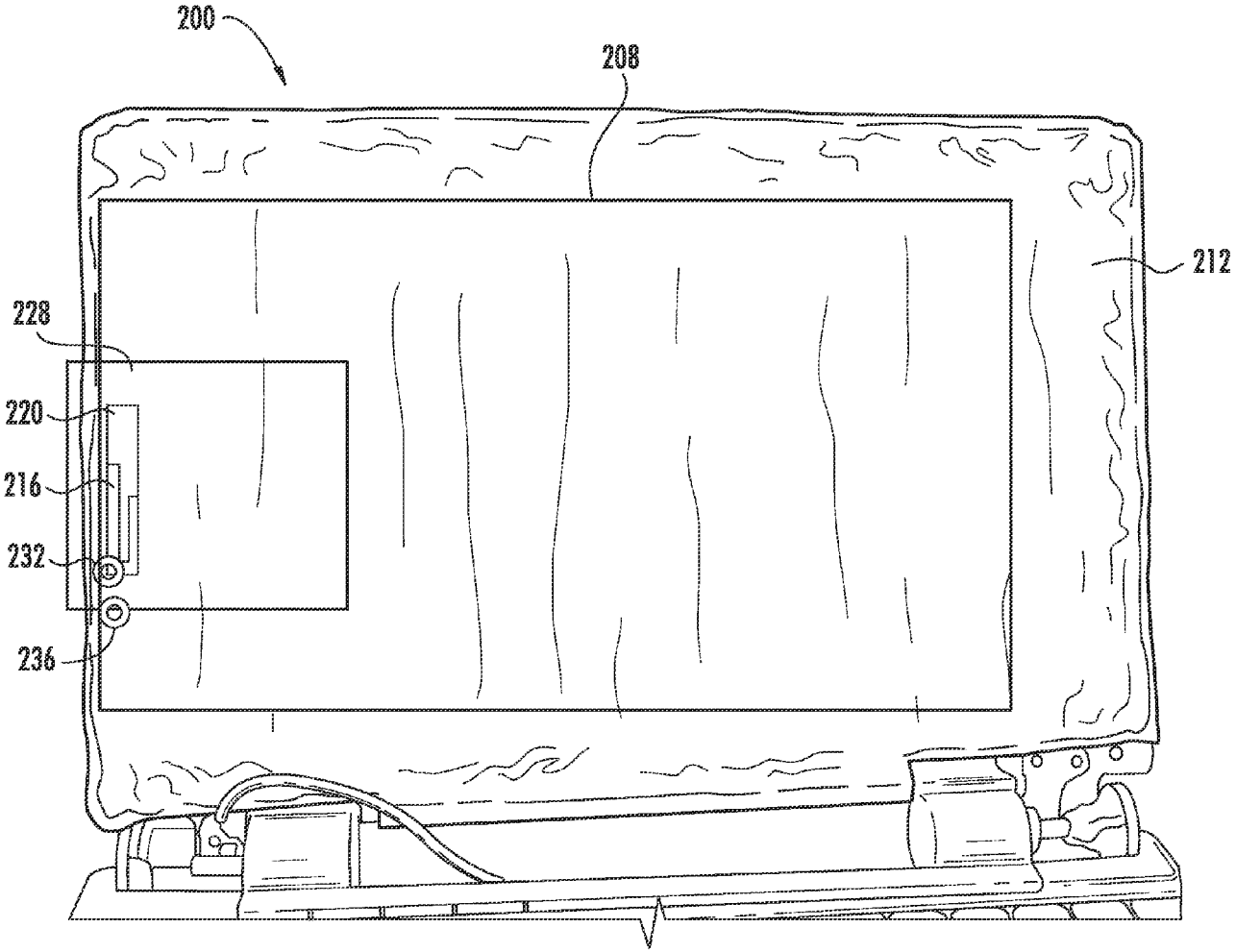
FIG. 11 illustrates a prototype configuration of a laptop cover assembly in accordance with one exemplary implementation of the disclosure.
Figure 15:
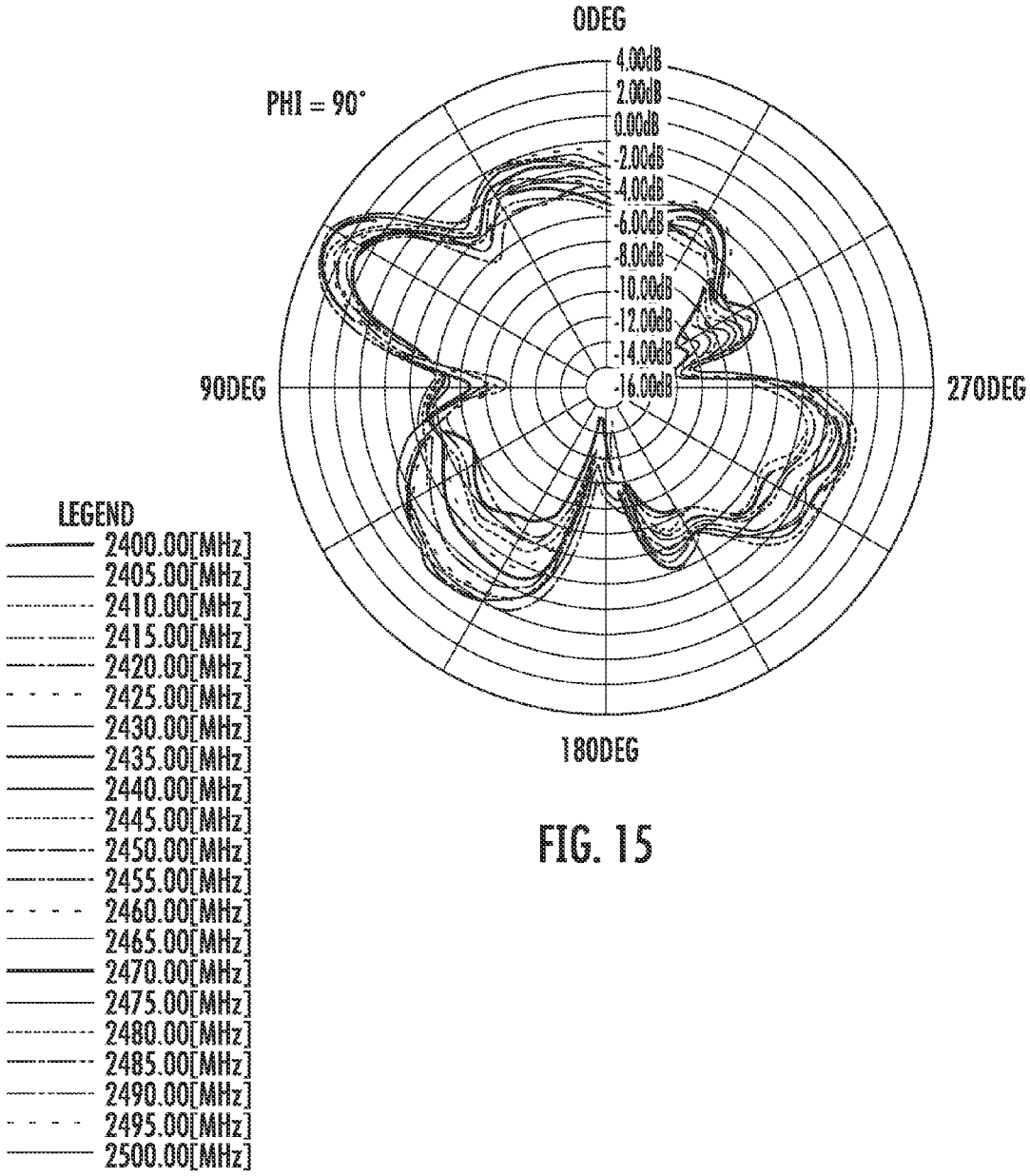
Figure 16:
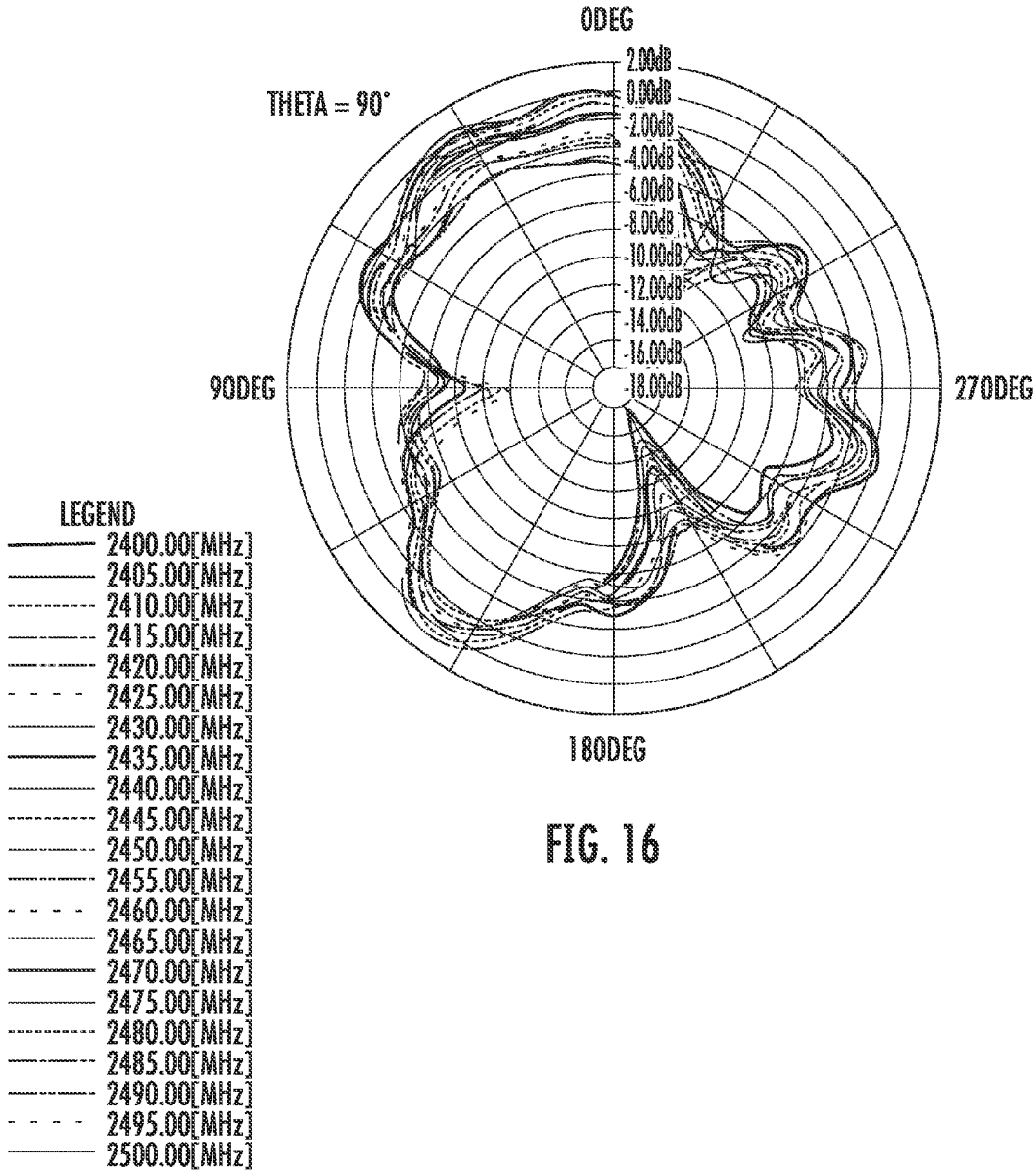

FIG. 15 illustrates a two-dimensional (2D) far-field radiation pattern in decibels measured at $\phi=90°$ for the prototype configuration shown in FIG. 11, over a frequency bandwidth from about 2400 Megahertz to about 2500 Megahertz; and FIG. 16 illustrates a two-dimensional (2D) far-field radiation pattern in decibels measured at $\theta=90°$ for the prototype configuration shown in FIG. 11, over a frequency bandwidth from about 2400 Megahertz to about 2500 Megahertz.

DETAILED DESCRIPTION

Example embodiments will now be described more fully with reference to the accompanying drawings.

In various implementations of the disclosure, an antenna may be mounted between the display panel and cover of a laptop so as to provide the antenna with space in which to radiate. Although various implementations of the disclosure are described with reference to laptop computers, it should be noted that the disclosure could also be implemented in connection with personal digital assistants (PDAs), mobile phones, and/or other electronic devices used for wireless applications and having a display panel mounted to a cover of the device. It should be noted further that the disclosure could be implemented in connection with electronic devices having metallic and/or non-metallic covers.

Figure 6:
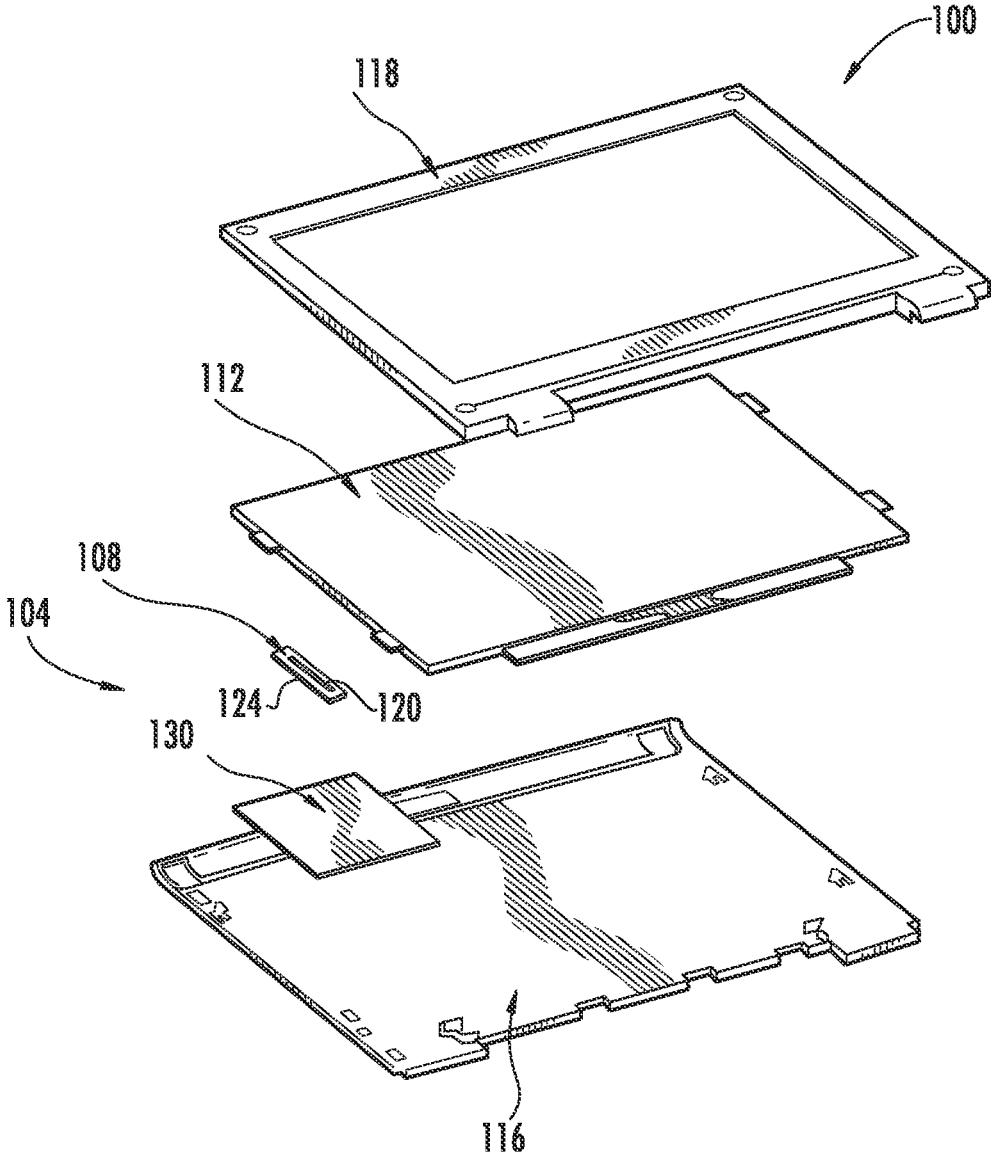
FIG. 6 is an exploded perspective view of an example embodiment of a laptop cover assembly including one or more aspects of the present disclosure.

With reference now to the drawings, FIG. 6 illustrates an example configuration of a cover assembly 100 in accordance with various aspects of the disclosure. The cover assembly 100 includes a cover 116 for an electronic device, which in the present example is a laptop computer. In the present example the cover 116 is metallic, although in other embodiments the cover of an electronic device may or may not be metallic. A display panel 112, e.g., a liquid crystal display (LCD), is configured to be secured to the cover 116 by a plastic bezel 118.

An antenna assembly 104 includes an antenna module 108 and a shielding layer 130. The antenna module 108 is configured to fit between the display panel 112 and the cover 116. The antenna module 108 includes an antenna 120 supported by a support 124, e.g., a plastic carrier or substrate. The antenna 120 may, for example, be stamped from sheet metal. Other or additional antenna fabrication methods, and/or various types of antennas, could be used, provided that the antenna module 108 has a sufficiently low profile to fit appropriately beneath the display panel 112 when the cover 116 and display panel 112 are assembled together. The antenna support 124 may be fabricated, for example, from a urethane such as PORON® by Rogers Corporation of Rogers, Conn., USA. Additionally or alternatively, the support 124 may be made from polycarbonate and acrylonetrile butadiene styrene (PC+ABS). Other or additional plastic materials, however, could be used to make the support 124.

The shielding layer 130 is configured to fit between the antenna module 108 and the cover 116. As further described below, the shielding layer 130 includes a grounding area configured for electrical connection with the antenna 120 and for electrical isolation from the cover 116. In such exemplary manner, the antenna 120 is provided with its own isolated grounding that can prevent (or at least inhibit) the antenna 120 from radiating off of the metallic cover 116. The grounding area can be sized to provide the antenna 120 with a predetermined resonant frequency and bandwidth.

The shielding layer 130 is illustrated conceptually in FIG. 6 as a perfect electric conductor (PEC) and is assumed to be a PEC in a computer simulation of the cover assembly 100 as further described below. The shielding layer 130 is made from a low-loss material and performs as a separating mechanism to prevent (or at least inhibit) energy loss from the metallic cover 116. When the antenna assembly 104 is combined with the cover 116, display panel 112, and bezel 118, the antenna module 108 has a profile extending above the shielding layer 130.

Figure 1:
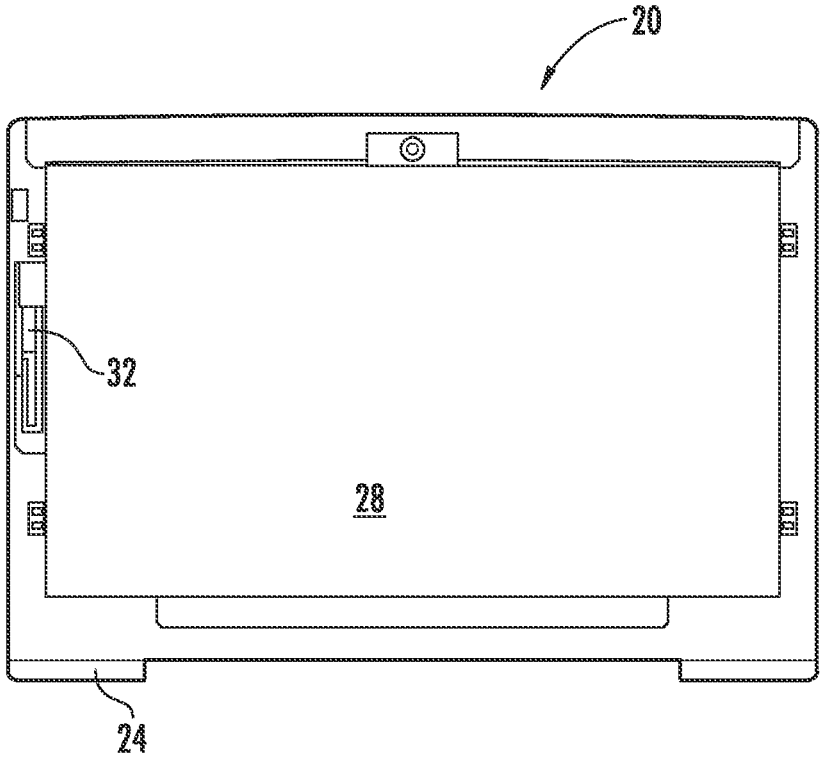
FIG. 1 (PRIOR ART)
FIG. 1 is a frontal view of a conventional antenna configuration in which an antenna is mounted adjacent a display panel of a laptop cover, the cover shown with a display panel bezel removed.
Figure 2:
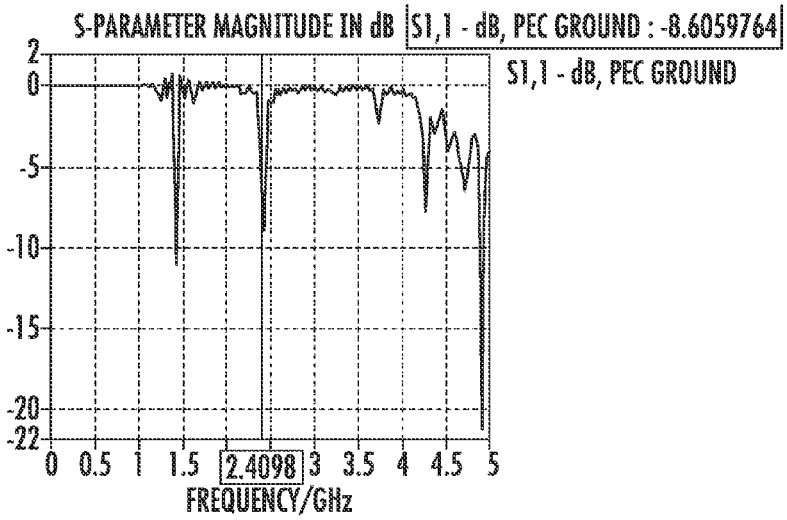
FIG. 2 is a graph illustrating simulated S11 return loss in decibels for the conventional laptop antenna configuration of FIG. 1 in which a plastic cover is used, over a frequency bandwidth from zero to about 5 Gigahertz.
Figure 3:
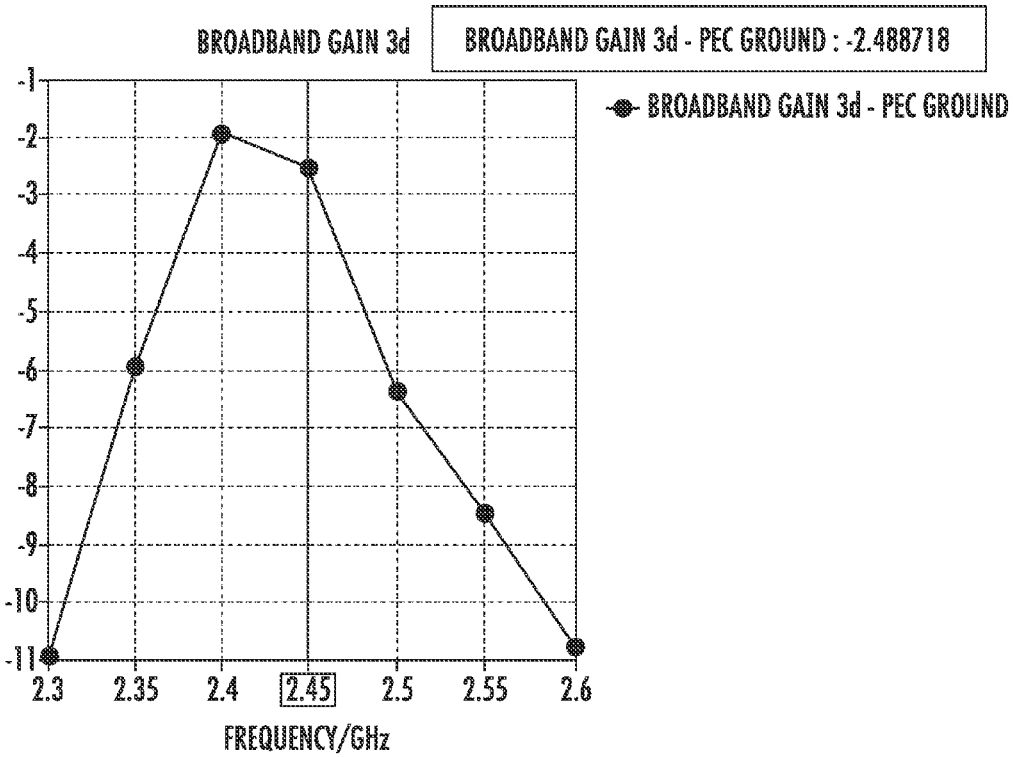
FIG. 3 is a graph illustrating simulated efficiency for the conventional laptop antenna configuration of FIG. 1 in which a plastic cover is used (expressed as broadband gain in decibels) over a frequency bandwidth from about 2.3 Gigahertz to about 2.6 Gigahertz.
Figure 4:
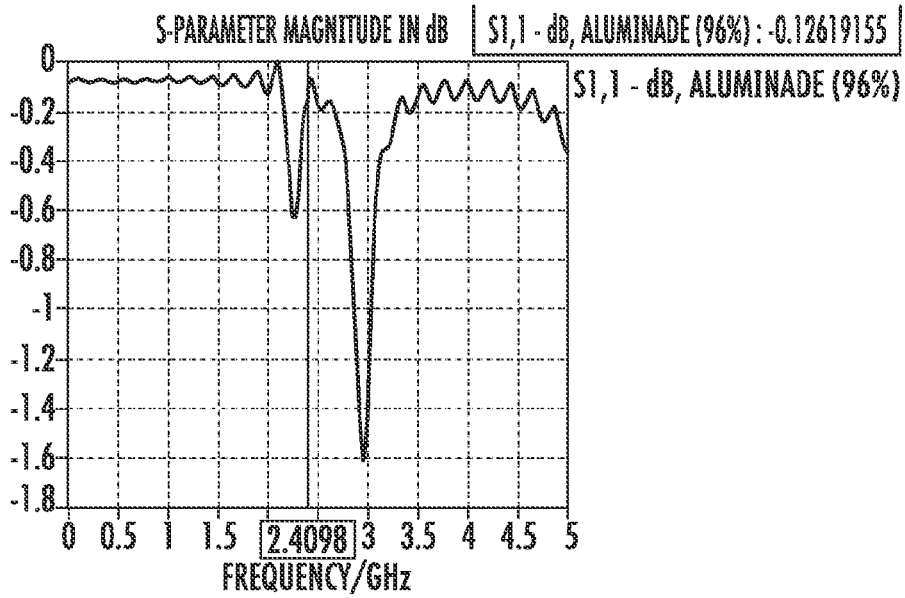
FIG. 4 is a graph illustrating simulated S11 return loss in decibels for the conventional laptop antenna configuration of FIG. 1 in which a 96% alumina cover is used, over a frequency bandwidth from zero to about 5 Gigahertz.
Figure 5:
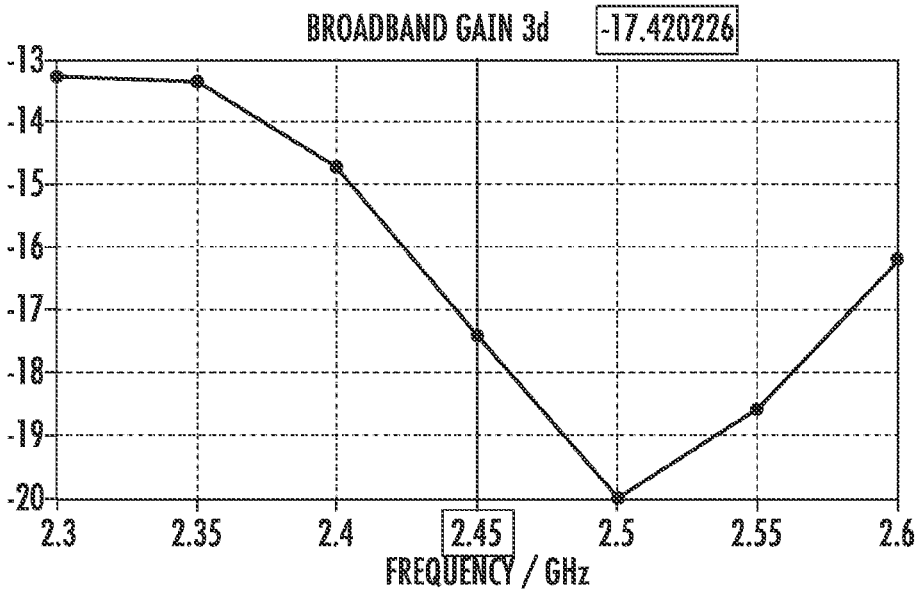
FIG. 5 is a graph illustrating simulated efficiency for the conventional laptop antenna configuration of FIG. 1 in which a 96% alumina cover is used (expressed as broadband gain in decibels) over a frequency bandwidth from about 2.3 Gigahertz to about 2.6 Gigahertz.
Figure 7:
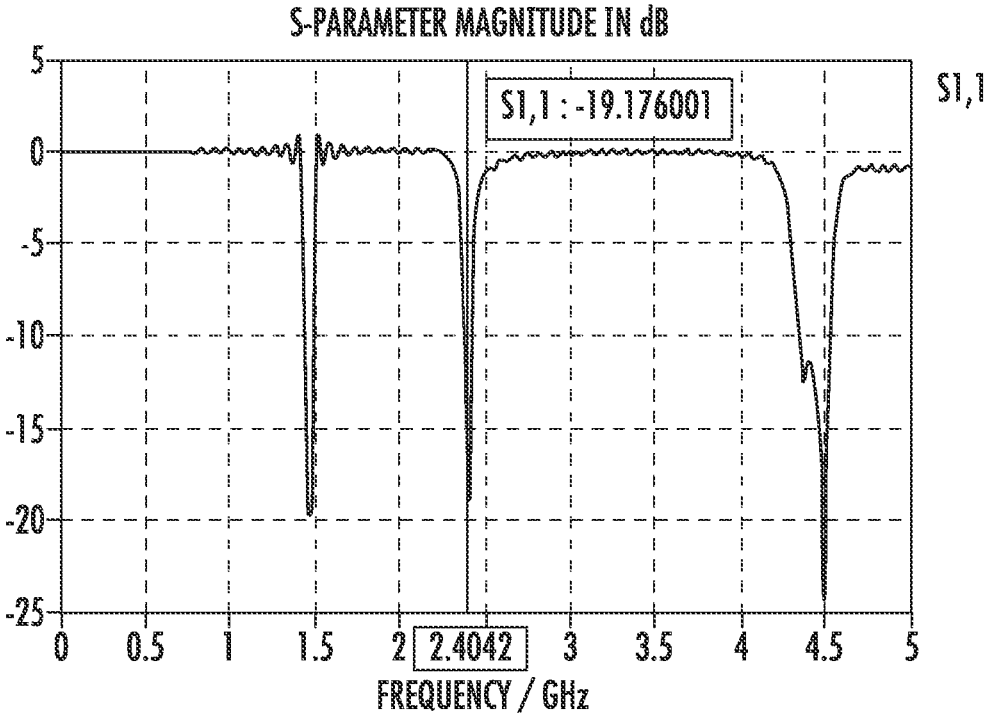
FIG. 7 is a graph illustrating simulated S11 return loss in decibels for the laptop cover assembly of FIG. 6 in which a magnesium/aluminum (Mg—Al) cover is used, over a frequency bandwidth from zero to about 5 Gigahertz.
Figure 8:
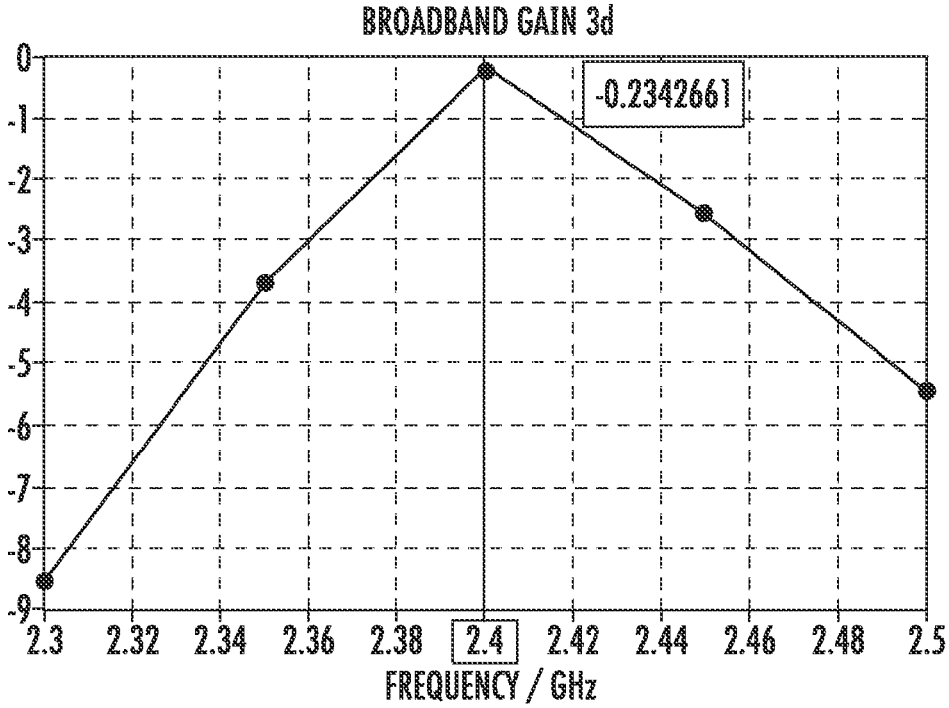
FIG. 8 is a graph illustrating simulated efficiency for the laptop cover assembly of FIG. 6 in which a magnesium/aluminum (Mg—Al) cover is used (expressed as broadband gain in decibels) over a frequency bandwidth from about 2.3 Gigahertz to about 2.5 Gigahertz.
Figure 9:
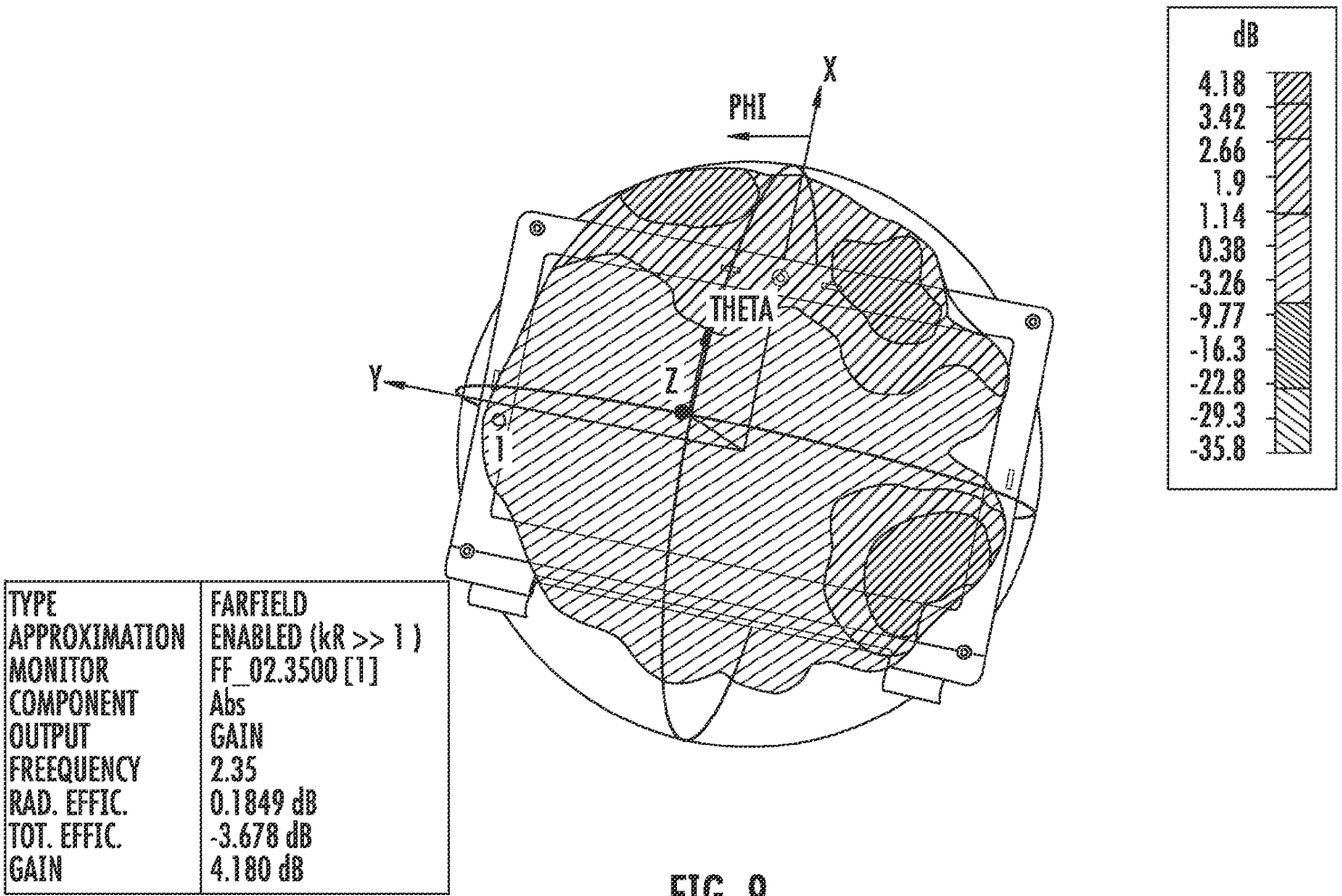
FIG. 9 illustrates a simulated three-dimensional (3D) far-field radiation pattern in decibels for the laptop cover assembly of FIG. 6 in which a magnesium/aluminum (Mg—Al) cover is used, the pattern taken at 2.35 GHz.
Figure 10:
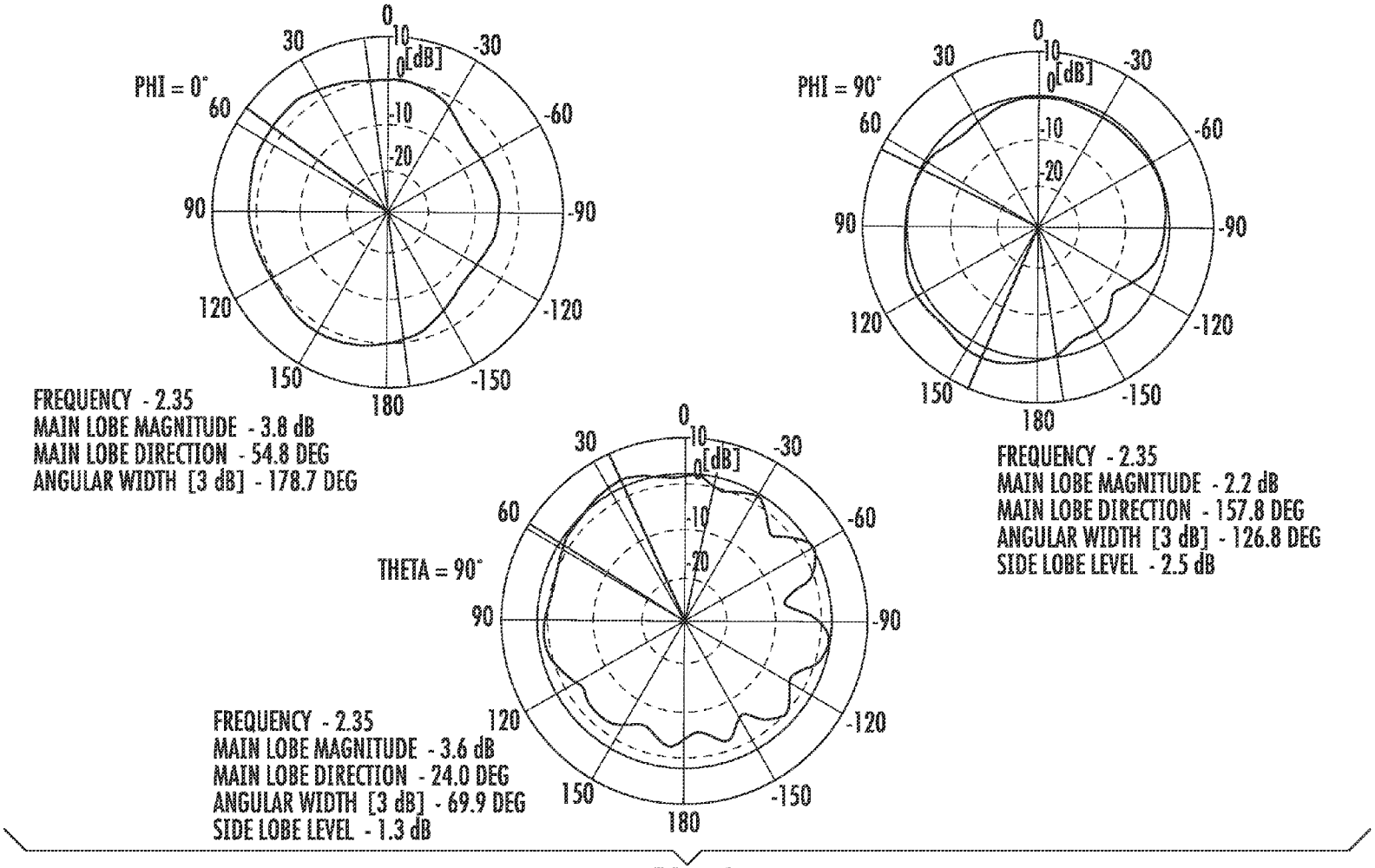
FIG. 10 illustrates in two dimensions the radiation pattern shown in FIG. 9.

A computer simulation of the cover assembly 100 was performed using software from CST Computer Simulation Technology, available from www.cst.com. The shield layer 130 was simulated as a PEC and the cover 116 was simulated as a magnesium/aluminum (Mg—Al) cover. Simulated return loss and efficiency for the cover assembly 100 are shown respectively in FIG. 7 and FIG. 8. These results compare favorably with the results shown in FIG. 4 and FIG. 5 for the conventional antenna configuration for a metal cover. A far-field radiation pattern was simulated at 2.35 Gigahertz and exhibited a −3.678 decibels total efficiency. The simulated cover assembly 100 exhibited a radiation pattern that is favorably omni-directional, as shown in FIGS. 9 and 10.

A prototype configuration of a laptop cover assembly is indicated generally in FIG. 11 by reference number 200. A shielding layer 208 is formed from a material that is mylar-like, specifically, biaxially-oriented polyethylene terephthalate (boPET). The shielding layer 208 is taped to a mockup 212 of a magnesium/aluminum cover. An antenna 216 made of stamped metal is provided on an antenna substrate 220 made of PORON®. The antenna 216 and substrate 220 are seated on the shielding layer 208 over a grounding area 228 and have a profile of approximately two (2) millimeters extending above the shielding layer 208. The antenna 216 has a feed point 232 and is connected at a grounding point 236 with the grounding area 228, which is electrically isolated from the metallic cover mockup 212.

In some exemplary configurations, the grounding area 228 may be affixed to the shielding layer 208 by an adhesive layer provided, e.g., on one side of the grounding area 228. In the example prototype 200, the grounding area 228 is positioned between the cover 212 and the shielding layer 208. Configurations also are contemplated in which the grounding area 228 is positioned between the antenna substrate 220 and the shielding layer 208. The grounding area 228 may include metal, e.g., deposited thereon. In some cover assemblies, a grounding area may be provided that is or includes a piece of sheet metal. In various configurations in which an adhesive is provided between the grounding area 228 and shielding layer 208, the adhesive is not electrically conductive and does not contribute to the performance of the antenna 216. In other configurations, the adhesive may be electrically conductive.

Figure 12:
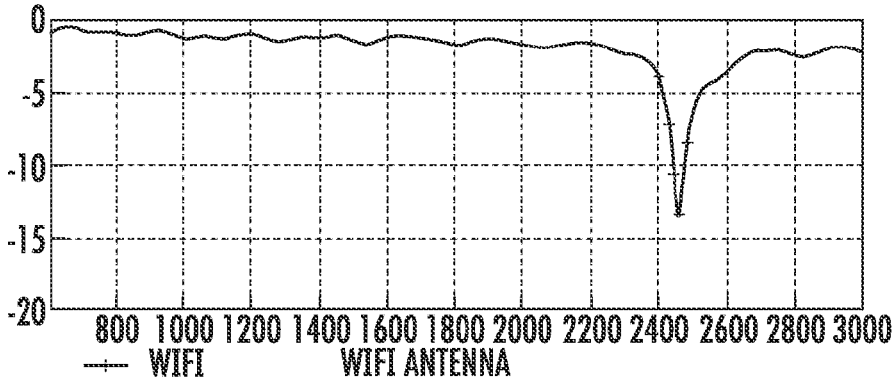
FIG. 12 is a graph and selected data points illustrating return loss in decibels for the prototype configuration shown in FIG. 11, over a frequency bandwidth from about 400 Megahertz to about 3000 Megahertz.
Figure 13:
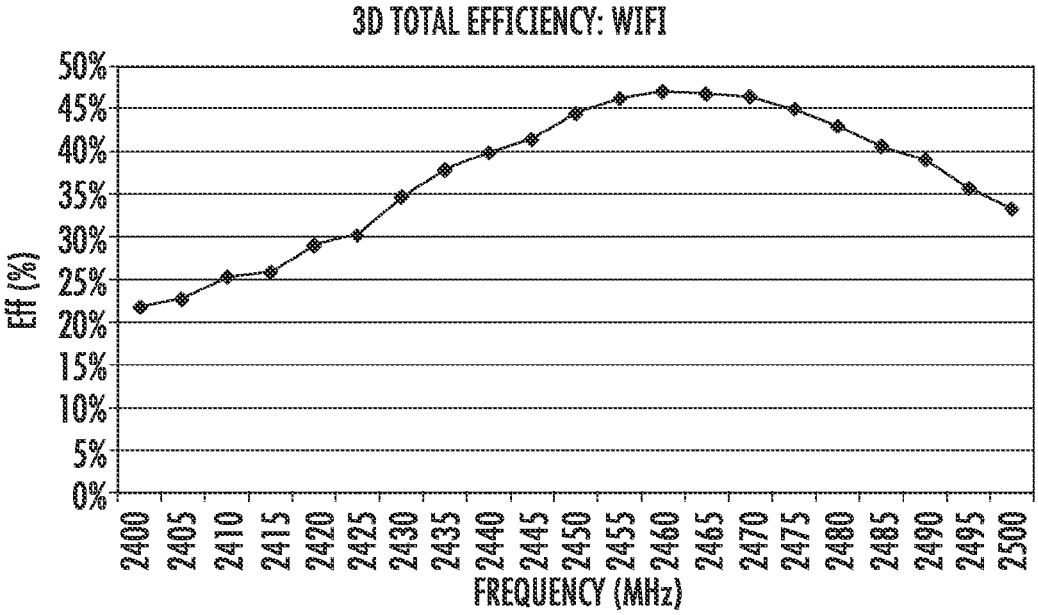
FIG. 13 is a line graph illustrating total efficiency as a percentage for the prototype configuration shown in FIG. 11, over a frequency bandwidth from about 2400 Megahertz to about 2500 Megahertz.
Figure 14:
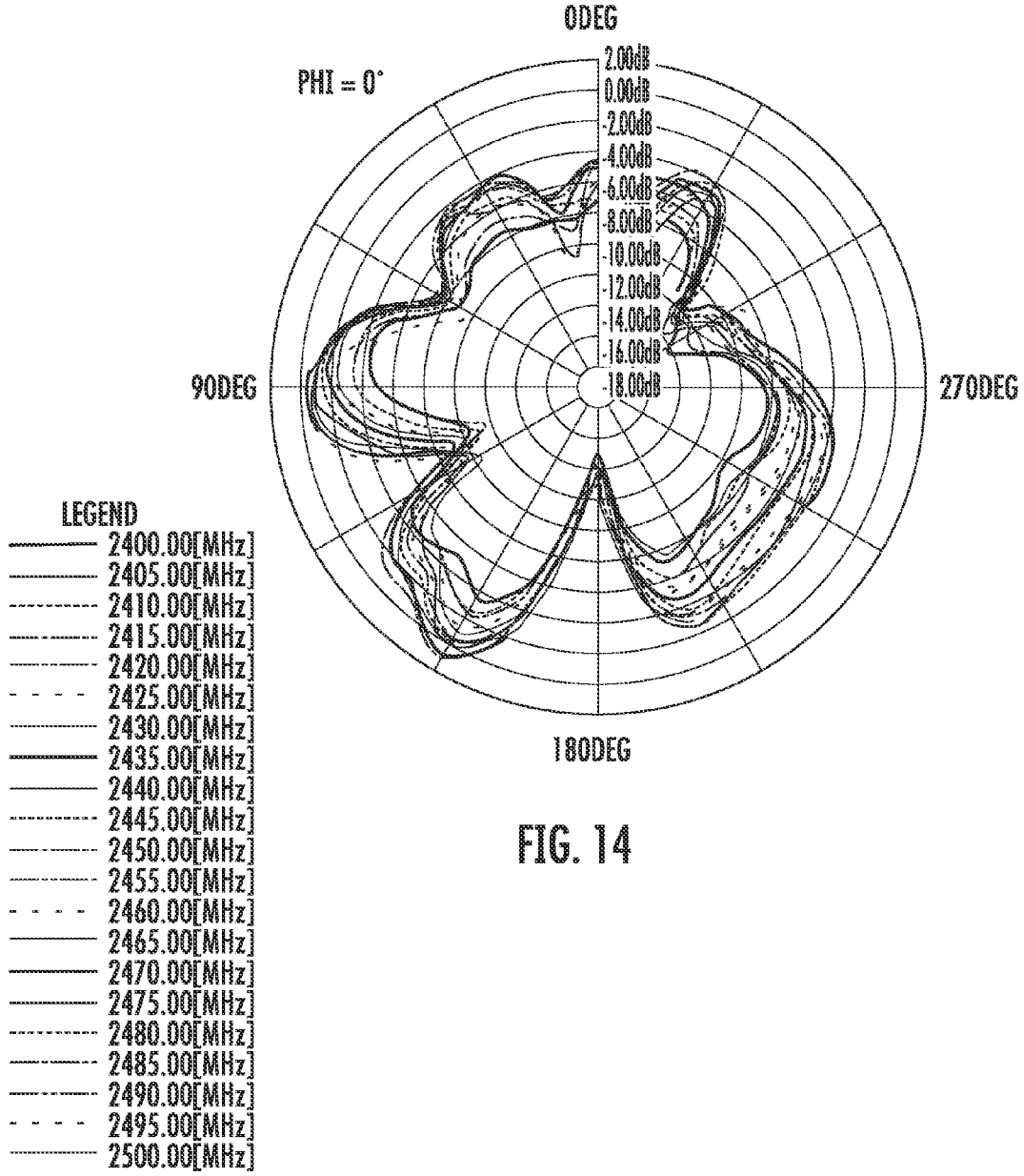
FIG. 14 illustrates a two-dimensional (2D) far-field radiation pattern in decibels measured at $\phi=0°$ for the prototype configuration shown in FIG. 11, over a frequency bandwidth from about 2400 Megahertz to about 2500 Megahertz.

Testing of the prototype configuration 200 produced results as shown in FIGS. 12 through 16. Return loss is shown in FIG. 12. Three-dimensional total measured efficiency is shown in FIG. 13. The test data supports a conclusion that the shielding layer 208 served to block (for the most part) interference that might be attributed to the metal cover 212, thereby allowing the antenna 216 to radiate effectively. As can be seen from FIGS. 14 through 16, antenna radiation in the actual assembly 200 is less isotropic than in the simulated assembly 100. Nevertheless, the radiation patterns shown in FIGS. 14 through 16 show general agreement with the simulation results. Notably, when an antenna module (such as the antenna module 108) is used that has a profile between approximately 2 and 3 millimeters, exemplary embodiments of the foregoing cover assemblies can provide design flexibility and leeway to reduce the sizes of laptops and other devices.

As is evident from the foregoing antenna and cover configurations, implementations of cover assemblies according to the present disclosure may be varied without departing from the scope of this disclosure and the specific configurations disclosed herein are exemplary embodiments only and are not intended to limit this disclosure. For example, as shown by a comparison of FIG. 6 with FIG. 11, the sizes, shapes, lengths, widths, spatial and electrical relationships, etc. of covers, display panels, shielding layers, grounding areas, antennas, and/or antenna supports may be varied. As will be understood by one of ordinary skill, one or more of such changes may be made to adapt an antenna to different frequency ranges, different device cover and/or display panel configurations, different dielectric constants of any substrate (or the lack of any substrate), enhance one or more other features, etc.

Implementations of antenna assemblies and cover assemblies as described in the disclosure provide a significant improvement over traditional antenna configurations, which are usually situated on a plastic cover. Embodiments of the simple platform configuration described in the disclosure can provide a "safe zone" in which an antenna can radiate freely in an otherwise strictly limited operational environment. Implementing a shielding layer embodiment between an antenna and a metallic cover can substantially eliminate (or at least substantially inhibit) energy loss while improving antenna performance. Various embodiments can be used to achieve antenna gain and radiation patterns that can be substantially omni-directional. Efficient antenna performance can be provided in a thinner, more visually appealing wireless application device. There is significant opportunity for cost control, for example, since stamping metal to make antennas is inexpensive compared to other WI-FI antenna fabrication methods. Using plastic carriers as antenna substrates is also considerably less expensive than using other materials.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms (e.g., different materials may be used, etc.) and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters (e.g., frequency ranges, etc.) are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna assembly comprising:

an antenna module fitting between a display panel of an electronic device and a cover of the device, the antenna module including an antenna and a support for the antenna; and a shielding layer fitting between the antenna module and the cover, the shielding layer having a grounding area configured for electrical connection with the antenna and for electrical isolation from the cover;

wherein:

the support for the antenna comprises a plastic material; and the antenna module comprises a profile configured to extend into a space between the shielding layer and the display panel.

2. The antenna assembly of claim 1, wherein the grounding area is configured to provide the antenna with a predetermined resonant frequency and bandwidth.

3. The antenna assembly of claim 1, wherein the antenna is made of sheet metal.

4. The antenna assembly of claim 1, configured for use with a metallic cover.

5. The antenna assembly of claim 1, wherein the antenna module is mounted over the grounding area.

6. The antenna assembly of claim 1, wherein:

the profile of the antenna module is less than or equal to approximately three (3) millimeters.

7. A laptop computer comprising a display panel, a cover, and the antenna assembly of claim 1, wherein the antenna module is between the display panel and the cover, and wherein the shielding layer is between the antenna module and the cover.

8. A cover assembly for an electronic device, the assembly comprising:

a cover;

an antenna module configured for coverage by a display panel for the device when the display panel is integrated with the cover, the antenna module including an antenna and a support for the antenna; and a shielding layer between the antenna module and the cover, the shielding layer having a grounding area configured for electrical communication with the antenna and for electrical isolation from the cover;

wherein:

the antenna module is mounted over the grounding area; and the cover assembly further comprises the display panel, and the antenna module comprises a profile extending into a space above the shielding layer, the space configured to be covered by the display panel.

9. The cover assembly of claim 8, further comprising the display panel.

10. The cover assembly of claim 8, wherein:

the antenna module comprises a profile extending into a space above the shielding layer, the space configured to be covered by the display panel; and/or the profile of the antenna module is less than or equal to approximately three (3) millimeters.

11. The cover assembly of claim 8, wherein the grounding area is configured to provide the antenna with a predetermined resonant frequency and bandwidth.

12. The cover assembly of claim 8, wherein:

the support for the antenna comprises a plastic substrate; and/or the cover comprises a metallic material; and/or the antenna is made of sheet metal.

13. The cover assembly of claim 8, wherein the antenna module is mounted over the grounding area.

14. A laptop computer comprising the cover assembly of claim 8 and a display panel integrated with the cover such that that the antenna module is covered by the display panel.

15. An electronic device having a display panel mounted in a cover, the electronic device comprising:

an antenna module including an antenna supported by a substrate mounted beneath the cover and behind the display panel; and a shielding layer between the antenna module and the cover, the shielding layer having a grounding area electrically isolated from the cover and electrically connected with the antenna; wherein:

the antenna substrate comprises a plastic material; and the cover comprises a metallic material; and/or the electronic device is configured to provide a clearance beneath the cover for a profile of the antenna.

16. The electronic device of claim 15, wherein the grounding area is configured to provide the antenna with a predetermined resonant frequency and bandwidth.

17. The electronic device of claim 15, wherein:

the antenna substrate comprises a plastic material; and the cover comprises a metallic material; and the antenna is made of sheet metal.

18. The electronic device of claim 15, wherein the antenna module is mounted between the display panel and the shielding layer over the grounding area.

19. The electronic device of claim 15, configured to provide a clearance beneath the cover for a profile of the antenna.

20. The electronic device of claim 15, wherein:

the electronic device is a laptop computer; and/or the antenna has a profile of less than or equal to approximately three (3) millimeters.

* * * * *